US009303392B2

(12) United States Patent
Strauli

(10) Patent No.: US 9,303,392 B2
(45) Date of Patent: Apr. 5, 2016

(54) DEVICE AND METHOD FOR USE IN PERSONAL HYGIENE, IN PARTICULAR WHEN TAKING A SHOWER OR A BATH OR WHEN WASHING HANDS

(75) Inventor: Urs Strauli, Stettfurt (CH)

(73) Assignee: Urs Strauli, Stettfurt (CH)

( * ) Notice: Subject to any disclaimer, the term of this patent is extended or adjusted under 35 U.S.C. 154(b) by 146 days.

(21) Appl. No.: 13/582,341

(22) PCT Filed: Feb. 18, 2011

(86) PCT No.: PCT/EP2011/000794

§ 371 (c)(1),
(2), (4) Date: Nov. 16, 2012

(87) PCT Pub. No.: WO2011/107221

PCT Pub. Date: Sep. 9, 2011

(65) Prior Publication Data

US 2013/0056086 A1 Mar. 7, 2013

(30) Foreign Application Priority Data

Mar. 1, 2010 (EP) ..... 10002077

(51) Int. Cl.

| | |
|---|---|
| ***F17D 1/00*** | (2006.01) |
| ***E03C 1/046*** | (2006.01) |
| ***A47K 5/12*** | (2006.01) |

(52) U.S. Cl.

CPC . *E03C 1/046* (2013.01); *A47K 5/12* (2013.01); *Y10T 137/0402* (2015.04); *Y10T 137/1632* (2015.04); *Y10T 137/2526* (2015.04); *Y10T 137/8593* (2015.04); *Y10T 137/85978* (2015.04)

(58) Field of Classification Search

CPC .... E03C 1/046; A47K 5/12; Y10T 137/0402; Y10T 137/1632; Y10T 137/8593; Y10T 137/85978; Y10T 137/2526

USPC ..... 222/1, 81–82, 129, 630, 132, 129.2, 222/144.5, 145.5, 325; 239/10, 310, 318; 137/888, 892–893

See application file for complete search history.

(56) References Cited

U.S. PATENT DOCUMENTS 3,486,695 A * 12/1969 Novak ..... 239/70
3,554,450 A * 1/1971 D'Muhala ..... 239/309

(Continued)

FOREIGN PATENT DOCUMENTS

BE 1006165 AS 5/1994
DE 199 15 322 C1 1/2001

(Continued)

OTHER PUBLICATIONS

International Preliminary Report on Patentability from International Patent Application No. PCT/EP2011/000794, mailed Sep. 25, 2012.

(Continued)

*Primary Examiner* — Frederick C Nicolas
(74) *Attorney, Agent, or Firm* — Alston & Bird LLP

(57) ABSTRACT

The invention relates to a device, to a capsule and to a method for use in personal hygiene, in particular when taking a shower or a bath or when washing hands. According to one aspect of the invention, a device for use in personal hygiene, in particular when taking a shower or a bath or when washing hands, is provided which is designed and adapted such that into the device a capsule, in particular a multi-chamber capsule, can be inserted. Advantageously, the device comprises an appliance for opening the capsule, such as by damaging a capsule wall in order to open the capsule. The appliance for opening the capsule can be adapted to push open or puncture the capsule wall, in particular to pierce a hole into the capsule wall. Advantageously, the capsule is a disposable capsule or an expendable article.

14 Claims, 6 Drawing Sheets

(56) References Cited

U.S. PATENT DOCUMENTS

| | | | | | |
|---|---|---|---|---|---|
| 3,720,352 | A | | 3/1973 | Kozlowski | |
| 4,055,246 | A | * | 10/1977 | Zalewski | 198/575 |
| 4,088,246 | A | | 5/1978 | Klingaman | |
| 4,099,672 | A | * | 7/1978 | Sheahan et al. | 239/317 |
| 4,135,646 | A | * | 1/1979 | Shaw | 222/144 |
| 4,201,316 | A | * | 5/1980 | Klingaman | 222/80 |
| 4,607,793 | A | * | 8/1986 | Eberle | 239/318 |
| 5,046,648 | A | * | 9/1991 | Herbstzuber | 222/638 |
| 5,071,070 | A | * | 12/1991 | Hardy | 239/311 |
| 5,213,264 | A | * | 5/1993 | Styne | 239/309 |
| 5,385,270 | A | * | 1/1995 | Cataneo et al. | 222/134 |
| 5,472,719 | A | | 12/1995 | Favre | |
| 5,957,379 | A | * | 9/1999 | McMorrow et al. | 239/10 |
| 6,006,374 | A | * | 12/1999 | Winnett et al. | 4/525 |
| 6,419,166 | B1 | * | 7/2002 | Brzezinski et al. | 239/310 |
| 6,814,306 | B1 | * | 11/2004 | Okubo | 239/316 |
| 7,143,897 | B1 | * | 12/2006 | Guzman et al. | 210/460 |
| 8,931,667 | B2 | * | 1/2015 | Smith et al. | 222/325 |
| 9,022,073 | B2 | * | 5/2015 | Strauli | E03C 1/046 137/888 |
| 2002/0153388 | A1 | * | 10/2002 | Klima et al. | 222/129 |
| 2010/0051642 | A1 | * | 3/2010 | Wong et al. | 222/52 |
| 2010/0071777 | A1 | * | 3/2010 | Smith et al. | 137/14 |

FOREIGN PATENT DOCUMENTS

| | | | |
|---|---|---|---|
| EP | 1 031 665 | A2 | 8/2000 |
| EP | 2 210 986 | A1 | 7/2010 |
| FR | 2 620 470 | A1 | 3/1989 |
| GB | 984125 | | 2/1965 |
| JP | 2000-197575 | A | 7/2000 |

OTHER PUBLICATIONS

International Search Report from International Application No. PCT/EP2011/000794, mailed May 3, 2011.

Written Opinion from International Application No. PCT/EP2011/000794, mailed May 3, 2011.

International Preliminary Report on Patentability from International Application No. PCT/EP2011/000794, mailed Sep. 3, 2012.

European Search Report for corresponding European Application No. 10002077.5 dated Sep. 1, 2010, 7 pages.

European Search Report for corresponding European Application No. 10013815.5 dated Feb. 8, 2011, 7 pages.

* cited by examiner

Section: B-B

DEVICE AND METHOD FOR USE IN PERSONAL HYGIENE, IN PARTICULAR WHEN TAKING A SHOWER OR A BATH OR WHEN WASHING HANDS

The invention relates to a device for use in personal hygiene, in particular when taking a shower or a bath or when washing hands, to a related method and to a capsule.

Shower or douche systems are typical components of modern bath rooms.

Ordinary shower or douche systems enable the "sprinkling" of a person using the shower or douche system with cold, warm or hot water.

The water is supplied to the respective shower system generally via a mixer tap, also called mixing faucet, or via a mixing fitting or mixing valve.

Technical apparatus in which valves which are operated by one or several handles control the mixing of liquids or gases, i.e. in the case of shower systems the mixing of hot and cold water, are referred to as mixer taps or mixing fittings.

The sprinkling with water in a shower system serves in particular the personal hygiene or body care but also serves the relaxation and the well-being.

Nowadays, the taking of a shower substitutes, to a certain extent, the taking of a bath. Numerous apartments or flats are not provided any longer with a bath tub, but only with a shower cubicle or cabinet.

There are free-standing or separate shower cubicles or cabinets with a small tub, but also showers integrated into bath tubs.

Today's showers often comprise massage showers (shower heads) which are supplied with warm and/or cold water from a one-hand or single-lever mixer tap.

The usual accessories for taking a shower or a bath or for washing hands are soap, shampoo, shower gel, lotion, etc.

It is particularly disadvantageous that usual containers for soap, shampoo, shower gel, lotion, etc. are relatively large, i.e. that a relatively large amount of the respectively desired ingredient (soap, shampoo, shower gel, lotion) is stored therein.

In order to prevent a waste of soap, shampoo, shower gel, lotion, etc., the respective user of the soap, shampoo, shower gel, lotion, etc. will normally only then use a new soap, shampoo, shower gel, lotion, etc. when the respective old soap, shampoo, shower gel, lotion, etc. is used up or consumed completely or almost completely.

This leads to a very restricted flexibility when taking a shower or a bath or when washing hands.

The invention has the object to provide an innovative device, an innovative capsule and an innovative method for use in personal hygiene, in particular when taking a shower or a bath or when washing hands.

The present invention achieves said object and further aims by the subject matters of the independent claims.

Advantageous further developments of the invention are mentioned in the subclaims.

In accordance with one aspect of the invention there is provided a device for use in personal hygiene, in particular when taking a shower or a bath or when washing hands, which is designed and adapted such that a capsule can be inserted into the device.

The capsule can comprise a single chamber in order to store a single ingredient—for instance a certain shampoo, and/or shower gel, and/or lotion, and/or soap—or, which is particularly advantageous, the capsule can comprise several chambers.

Furthermore, the capsule can be replaced by a new capsule, i.e. the capsule can be exchanged for a new capsule—in particular for instance when its ingredient is used up or consumed.

Advantageously, a one-way capsule or a disposable throw-away capsule, i.e. an expendable article, is used as the capsule, and the device can comprise a capsule opening mechanism or an appliance for opening the capsule with means for damaging a capsule wall in order to open the capsule.

The capsule opening mechanism or the appliance for opening the capsule or the means for damaging the capsule wall can, for instance, be adapted to push open, break through or penetrate the capsule wall, in particular to pierce a hole into the capsule wall, or in any other manner.

The invention will now be described in more detail by means of several embodiments as well as by means of the accompanying drawings in which:

FIG. 1 shows, in a diagrammatic and exemplary manner, a shower system 10 in which a device 1 for use in personal hygiene according to an embodiment of the present invention can be used.

The device 1 for use in personal hygiene can principally be used in any shower system 10, for instance in a shower system with a shower cubicle or cabinet, in a floor-level shower, in a large-capacity shower, etc.

The shower system 10 can comprise a waterproof curtain ("shower curtain"), and/or one or several sliding doors or pivoted doors for separating the shower system from the surroundings in order to protect the surroundings from splashing water.

The shower system 10 can for instance be a floor-level shower or a walk-in shower. Therein the wall and the floor of the shower area are tiled or otherwise clad in a watertight manner; the floor is slightly inclined towards the drain. Said design also renders possible the use with wheelchairs or other walking aids. Further additions adapted to the needs of the disabled can be seating accommodations and grab handles.

Instead of being used in a shower system 10, the device 1 for use in personal hygiene can alternatively for example also be used in a system with a bath tub, in particular in a bath tub provided with a shower system, or for example also in a system with a wash-bowl or wash-basin or a bidet, etc.

The above-mentioned shower cubicle, the above-mentioned floor-level shower, the above-mentioned bath tub, the above-mentioned large-capacity shower, the above-mentioned wash-bowl, bidet, etc., can be located for instance in a bath room of an apartment or a flat or of a residential house, or at any other place, for instance in a public or private swimming bath or bathing establishment, in a hotel, in a motel, in a boarding-house, in a restaurant, in a fitness center, in the shower rooms of a sports club, etc., etc.

Figure 1:
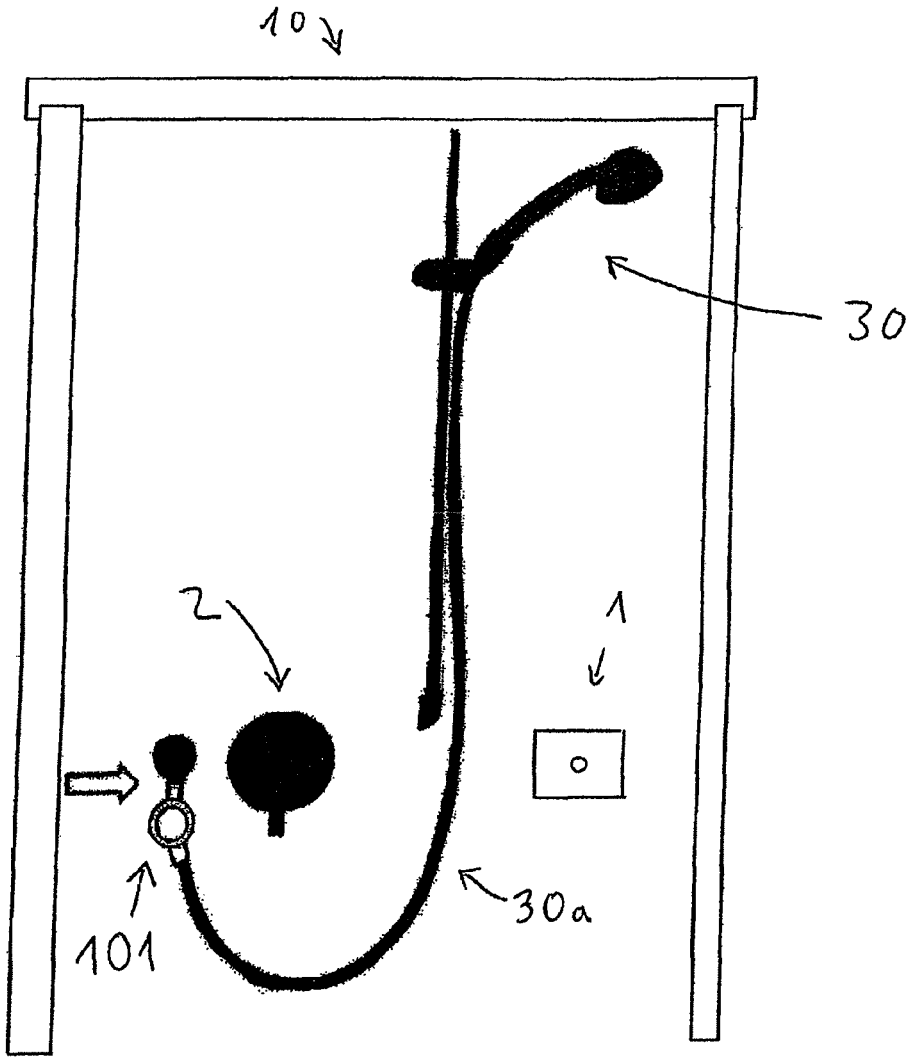
FIG. 1 is a diagrammatic, exemplary representation of a shower system in which the device for use in personal hygiene according to an embodiment of the present invention can be used.

As is shown in FIG. 1, the above-mentioned shower system 10 can comprise a mixer tap or a mixing fitting 2.

As a mixer tap or a mixing fitting there can principally be used any mixer tap or mixing fitting, for instance according to FIG. 1 a one-hand or single-lever mixer tap with or without thermostat, or any other mixer tap, for instance a mixer tap with sensor control instead of lever control. The mixing tap can for instance be arranged in the bath room or at any other place, for instance in the basement.

Into the mixer tap or the mixing fitting 2 there can be introduced correspondingly hot water via a hot water supply and correspondingly cold water via a cold water supply.

In the mixer tap or the mixing fitting 2, the mixing of the hot and cold water can be controlled by means of valves which are operated by one or several handles.

In this manner, the temperature of the water supplied to a shower head 30 via the mixer tap or mixing fitting 2 via a pipe or a tube 30*a* as well as/or the supplied amount of water can be adjusted according to the wishes of the respective user of the device 1.

Instead of the shower head 30 shown in FIG. 1 having a hand shower which can be taken out of a holder attached at the wall of the shower system 10, in principle any other shower head can be used, for instance a shower head which is fixedly mounted at the wall or at the ceiling of the shower, etc.

The device 1 for use in personal hygiene shown in FIG. 1 can be fixedly connected with the shower system 10 (or the above-mentioned system with bath tub, wash-bowl, bidet, etc.), it can for instance be mounted in a detachable or non-detachable manner at a wall of the shower system or shower cubicle (or at a wall of the above-mentioned system with bath tub, wash-bowl, bidet, etc.), and/or it can be mounted at the above-mentioned pivoted door, sliding door, curtain, etc. and/or at any other door or wall, in particular at a door or wall which is located in the vicinity of the above-mentioned systems (shower system 10, system with bath tub, wash-bowl, bidet, etc.), for instance at a wall or door which is arranged closer than 4 m, in particular closer than 2 m or 1 m, to the respective shower, bath tub, wash-bowl, bidet, etc.

The device 1 for use in personal hygiene—and in particular its housing 16 (see below)—can, for instance, comprise one or more suckers by means of which the device 1 can be attached at the above-mentioned wall/door/curtain.

Alternatively, the device 1 for use in personal hygiene—and in particular its housing 16 (see below)—can also be attached by means of an adhesive, for instance by means of adhesive tapes, at the above-mentioned wall/door/curtain, etc.

In further alternative variants, the device 1 for use in personal hygiene—and in particular its housing 16 (see below)—can also be connected with the above-mentioned wall/door/curtain by means of respective screw connections or couplings and/or plug connections, for instance by providing the above-mentioned wall, door, etc. with drill holes into which respective dowels or plugs are inserted into which screws are screwed in which hold the device 1.

Alternatively, the device 1 for use in personal hygiene can for instance also be fastened by means of nails at the above-mentioned wall, door, etc., or in any other manner.

In further variants, it can be done without any fastening of the device 1—the device 1 can, for instance, be put down on the floor or on an edge of the respective shower or shower tub, bath tub, wash-bowl, bidet, or on a fitting, a piece of furniture etc. arranged nearby the shower or shower tub, bath tub, wash-bowl, bidet, etc. (in particular on a piece of furniture, a fitting, etc. which is arranged closer than 4 m, in particular closer than 2 m or 1 m, to the respective shower, bath tub, wash-bowl, bidet, etc.).

In further alternative embodiments, the device 1 can also be integrated in a mixer tap or a mixing fitting, and/or in the above-mentioned wall, and/or in the above-mentioned piece of furniture, and/or in the above-mentioned shower tub, the above-mentioned bath tub, the above-mentioned wash-bowl, the above-mentioned bidet, etc.

Figure 2:
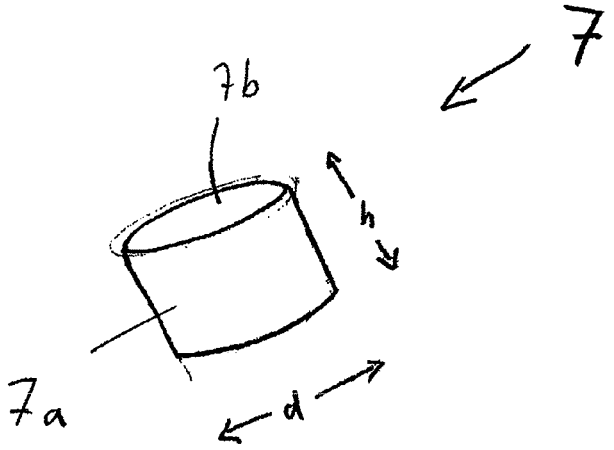
FIG. 2 is a diagrammatic, exemplary representation of a capsule which can be inserted into a device for use in personal hygiene.

In FIG. 2 there is shown a diagrammatic, exemplary representation of an—exchangeable—capsule 7 which can be inserted into the device 1 for use in personal hygiene.

As becomes obvious from FIG. 2, the capsule 7 can be designed similar to a capsule or cartridge used in a fully automated coffee machine for the supply of coffee.

The capsule 7 can for instance be designed and shaped to be substantially cylindrical, or in any other manner, for instance cube-shaped, etc., etc.

The lateral outer wall 7*a* of the capsule 7 can for instance be made of plastics material, and/or of a metal, e.g. aluminum, etc.

Correspondingly similar, also the top wall 7*b* of the capsule 7 and/or the bottom wall of the capsule 7 can for instance be made of plastics material, and/or of a metal, e.g. aluminum, etc.

According to FIG. 2, the bottom wall and/or the top wall 7*b* of the capsule 7 can have a circular cross-section (or any other cross-sectional form, for instance elliptical, quadratic, rectangular, hexagonal, pentagonal, etc.).

The capsule 7 is relatively small: The height h of the capsule 7 can for instance be smaller than 5 cm or 4 cm, in particular smaller than 3 cm or 2 cm. Correspondingly, the diameter d of the capsule 7 can for instance be smaller than 6 cm or 5 cm, in particular smaller than 4 cm or 2 cm, etc.

Hence, the total amount of ingredient (soap, and/or shampoo, and/or shower gel, and/or lotion) stored in the capsule 7 is relatively small, e.g. smaller or less than 100 ml or 50 ml, in particular smaller or less than 30 ml or 10 ml, etc.

In particular, the respective amount of ingredient is chosen such that it is sufficient for one single showering process, and/or bathing process, and/or hand washing process, but not for several of such processes.

Alternatively, the respective amount of ingredient can be chosen such that it is sufficient for only relatively few showering processes and/or bathing processes and/or hand washing processes, for instance only for two to ten, in particular two to four, but not for several of such processes.

The capsule 7 can comprise one single chamber in order to store a single ingredient—for instance a certain shampoo, and/or shower gel, and/or lotion.

Alternatively, the capsule 7 can comprise several chambers, for instance 2, 3, 4, 5, 6, 7, 8, 9, or 10 or more chambers.

In each chamber there can be stored an ingredient of a different kind, for instance in a first chamber a shampoo, in a second chamber a shower gel, in a third chamber a lotion, etc.

Alternatively or additionally, in two or more chambers, respectively, there can be stored different ingredients of the same kind, for instance in a first chamber a first shampoo, in a second chamber a second shampoo which differs from the first shampoo, and/or in a third chamber a third shampoo which differs from the first shampoo and the second shampoo, and/or in a further chamber a first shower gel, and/or in an additional chamber a second shower gel which differs from the first shower gel, and/or in still another chamber a third shower gel which differs from the first and the second shower gels, etc.

The chambers can all be designed to be substantially of the same size and/or can each store substantially the same amount of ingredient; alternatively, some chambers can be designed to be larger and other chambers can be designed to be smaller, wherein a larger chamber can be larger e.g. by more than 10% or 20%, in particular by more than 50% or 100% than a smaller chamber.

The above-mentioned different ingredients of the same kind (e.g. the above-mentioned first and second and third shampoo, the above-mentioned first and second and third shower gel, etc.) can differ from each other for instance with respect to the respective fragrance note or in any other manner.

For the generation of the respective—and possibly different—fragrance notes, respectively different soluble natural essences, for instance essential oils of plant and/or animal origin, and/or respectively different synthetically produced fragrances, for instance synthetic essential oils or smelling substances, and/or respectively different amounts of the above-mentioned elementary ingredients or of any other elementary ingredients can be added to the respective (different) shampoos, (different) shower gels, (different) lotions, etc., correspondingly in a usual manner.

The respective (different) shampoos, (different) shower gels, (different) lotions, etc., can thus have different fragrance notes, respectively, due to different fractions of the above-mentioned elementary substances, for instance, corresponding floral-feminine, masculine, oriental, fruity, powdery, citrus-fresh or classical-elegant nuances of fragrances, etc., etc.

Prior to the insertion of the capsule 7 shown for instance in FIG. 2 into for example the device 1 for use in personal hygiene as shown in FIG. 1, the ingredient or the ingredients of the capsule 7—for instance the above-mentioned shampoo, and/or shower gel, and/or lotion—will be tightly enclosed by the capsule walls, in particular by the above-mentioned lateral outer wall 7*a* of the capsule 7 and the bottom wall and top wall 7*b* of the capsule 7.

Figure 3:
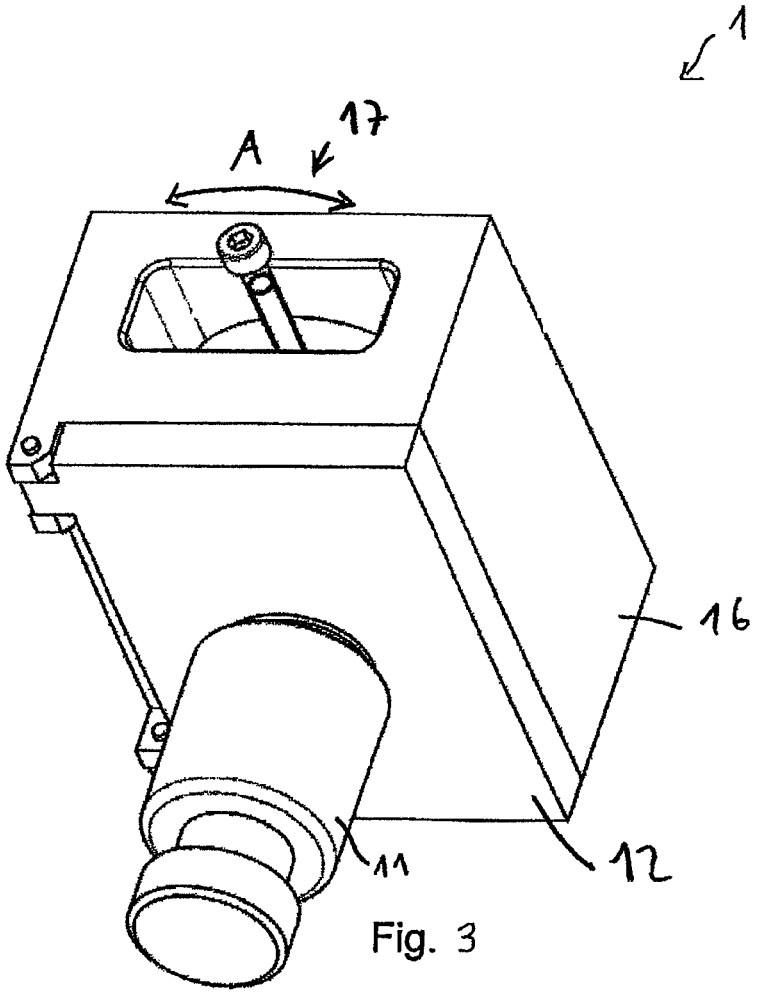
FIG. 3 is a perspective detailed view of a device for use in personal hygiene according to an embodiment of the present invention in the assembled state.
Figure 4:
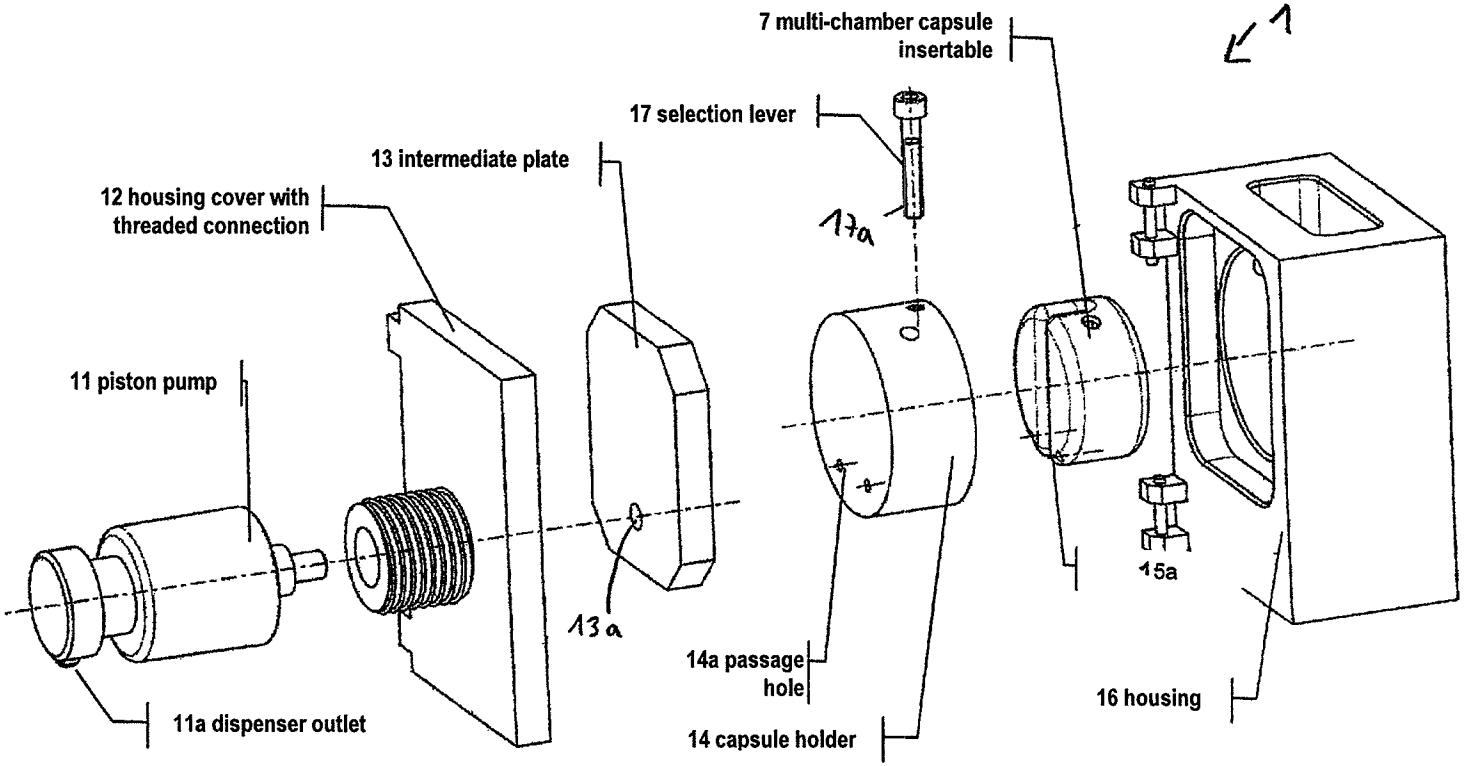
FIG. 4 is a perspective detailed view of the device for use in personal hygiene as shown in FIG. 3 in the disassembled state.
Figure 5:
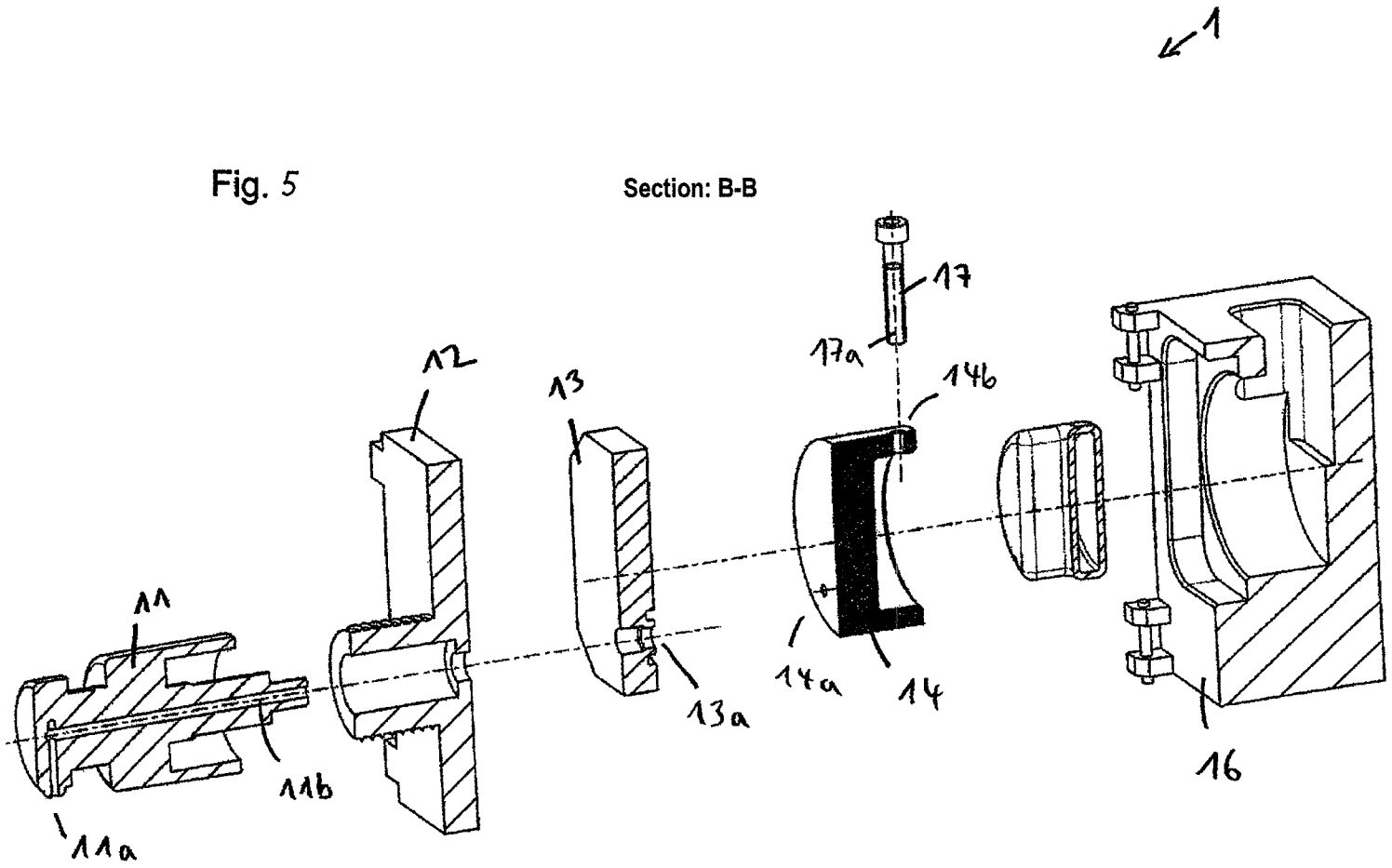
FIG. 5 is a sectional view of the device parts shown in FIG. 4.

In FIG. 3 there is shown a perspective detailed view of the device 1 for use in personal hygiene shown in FIG. 1 in an assembled state, and in FIG. 4 there is shown a perspective detailed view of the device 1 in the disassembled state; FIG. 5 shows a sectional view of the device parts shown in FIG. 4.

As becomes obvious from FIGS. 3 to 5, the device 1 comprises for instance a housing 16, a housing cover 12 with a threaded connection, a piston pump 11 with a dispenser outlet 11*a*, a capsule holder 14 with a through-flow or passage hole 14*a*, a selection lever 17 and an intermediate plate 13.

When the capsule 7 shown in FIG. 2 or a correspondingly similar capsule or a capsule constructed as described above is inserted into the device 1, for instance into the capsule holder 14 of the device 1 as shown in FIG. 4 and FIG. 5, the capsule 7 can be activated or put into operation.

In particular, after the insertion of the capsule 7 into the device 1, the capsule 7 can be opened correspondingly—for instance in a similar manner as is the case with capsules used in fully automated coffee machines—, for instance by piercing a hole into one of the walls of the capsule 7, in particular e.g. into its top wall 7*b* (or its bottom wall, or its lateral outer wall 7*a*, etc.), or in any other manner.

The opening or piercing, puncturing or perforating of the capsule 7 can for instance be effected by means of a pointed or sharp pin, or for instance by means of a pointed or sharp nozzle, or in any other manner.

For the insertion of the capsule into the device 1, for instance the housing cover 12 of the device 1 can be brought from the—closed—state as shown in FIG. 3 into an opened state.

Thereupon, the capsule 7 can be put into the capsule holder 14, and then the housing cover 12 can be closed once again, i.e. it can be brought back again into the state as shown in FIG. 3.

Advantageously, the capsule 7 will be automatically opened/punctured, pierced or perforated when the housing cover 12 is being closed, for example by the fact that, by the movement of the housing cover 12 during closing, the above-mentioned pin or the above-mentioned nozzle is moved along together therewith toward the capsule 7 (and/or the capsule 7 toward the pin/nozzle) until the point of the pin or of the nozzle penetrates the above-mentioned wall of the capsule 7.

Thereupon, the ingredient stored in the capsule 7 can be taken out, for instance by operating the piston pump 11, e.g. by operating a push button formed thereat.

By operating the piston pump 11, the ingredient is sucked out of or squeezed out of the capsule 7 and is moved for instance through the above-mentioned nozzle penetrating the capsule 7, through a passage hole 14*a* provided in the capsule holder 14, a hole 13*a* in the intermediate plate 13, one or several pipes or conduits 11*b* in the piston pump 11 toward the dispenser outlet 11*a* and is delivered out of an opening provided thereat.

The capsule 7 can be replaced by a new capsule—in particular for instance when the content of the capsule 7 is used up.

For the replacement of the capsule 7 in the device 1, for example the housing cover 12 of the device 1 can be brought once again from the—closed—state as shown in FIG. 3 into an opened state.

Thereupon, the capsule 7 can be removed from the capsule holder 14, and a new capsule can be inserted into the capsule holder 14.

Then the housing cover 12 can be closed once again, i.e. it can be brought once again back into the state shown in FIG. 3, wherein, in doing so,—as explained above—, the new capsule can be automatically opened/punctured, pierced or perforated.

As already mentioned above, the capsule 7 can comprise a single chamber or—alternatively—several chambers.

As becomes obvious from FIG. 4 and FIG. 5, the capsule holder 14 can be pivoted in the device 1, for instance such that the capsule holder 14 can be rotated around its center axis.

For the rotation of the capsule holder 14 there is used the above-mentioned selection lever 17 (see FIGS. 3-5):

The selection lever 17—in particular its lower part 17*a*—can for instance be formed (in an assembled state of the device 1) such that it extends through a passage opening 14*b* through the capsule holder 14.

When pivoting the selection lever 17 to the left or to the right (e.g. in the direction of the arrow A shown in FIG. 3), the capsule holder 14 will be moved along therewith correspondingly, i.e. will be rotated to the left or to the right, as in the assembled state of the device 1 the lower part 17*a* of the selection lever 17 is arranged in the passage opening 14*b* of the capsule holder 14.

By the rotational movement of the selection lever 17 or of the capsule holder 14, also the capsule 7 inserted therein can be taken along therewith correspondingly (either e.g. directly by the capsule holder 14 (i.e. only indirectly by the rotational movement of the selection lever 17), and/or directly by the selection lever 17 (i.e. directly by the rotational movement of the selection lever 17)), i.e. it can be rotated to the left or to the right.

When the capsule 7 comprises several chambers, depending on the rotational position of the capsule 7 optionally either its first chamber is in communication with the dispenser outlet 11*a* (e.g. via the passage hole 14*a* in the capsule holder 14, the hole 13*a* in the intermediate plate 13, and the conduits 11*b* in the piston pump 11), or its second chamber (e.g. via a second passage hole in the capsule holder 14, the hole 13*a* in the intermediate plate 13, and the conduits 11*b* in the piston pump 11) or its third chamber (e.g. via a third passage hole in the capsule holder 14, the hole 13*a* in the intermediate plate 13, and the conduits 11*b* in the piston pump 11) is in communication with the dispenser outlet 11*a*, etc., etc.

For this reason, the user can take out several different ingredients (stored in different capsule chambers, respectively) from the capsule 7, e.g. different shampoos, and/or shower gels, and/or lotions, etc.—particularly for instance also during one and the same showering, bathing or hand washing process.

Due to this, a high flexibility when taking a shower or a bath or when washing hands can be achieved.

Figure 6:
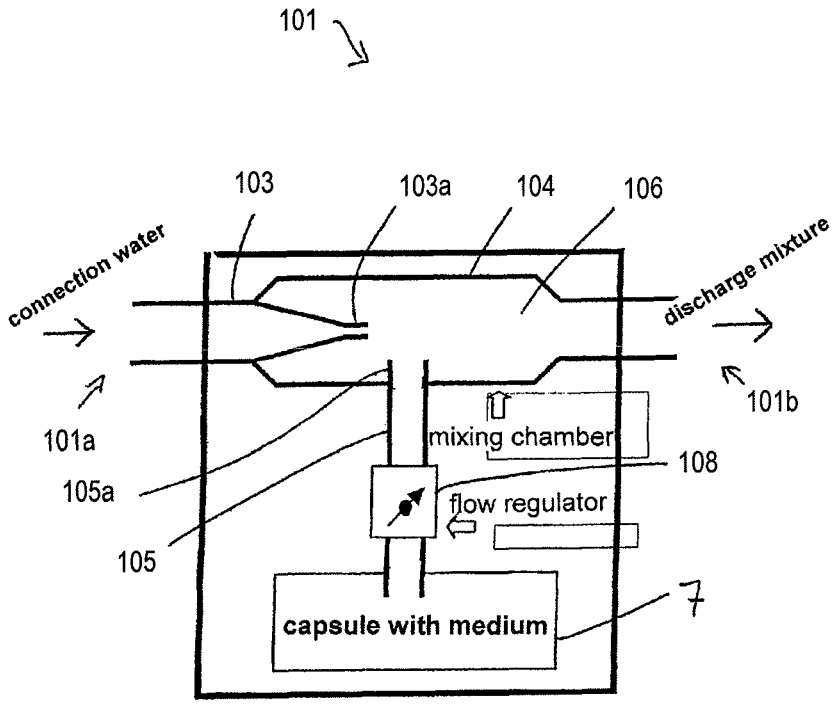
FIG. 6 is a diagrammatic representation of a device operating according to the concept of a water jet pump

Advantageously, the capsule 7 can be designed such that, instead of being used in the device 1 as shown in FIGS. 1, 3-5, it can be used additionally in a plurality of other devices which are designed similar or different to the device shown in FIGS. 1, 3-5, for instance also as a capsule for the device 101 which is shown—schematically—in FIG. 6, or for any other device.

The device 101 works according to the concept of a water jet pump which will be explained in detail in the following under reference to FIG. 6.

A water jet pump has two inlets or entries and one outlet or exit and, in principle, consists of two pipes 103, 104 fitted into each other.

The pipes 103, 104 have diameters of different sizes.

A suction line 105 is connected with the pipe 104 having the larger diameter.

A water connection or supply 101 a of the device 101 acts as the first inlet or entry of the water jet pump, and the outlet of the suction line 105, for instance a corresponding vacuum outlet 105*a*, acts as the second inlet or entry.

The water discharge 101*b* of the device 101 constitutes the exit or outlet of the water jet pump.

As is illustrated in FIG. 6, at the outlet of the pipe 103 there is provided a nozzle 103*a* ("propelling nozzle").

The diameter or the cross-section $A_2$ of the nozzle 103*a* is smaller than the diameter or cross-section $A_1$ of the pipe 103.

The water supplied via the first inlet of the water jet pump, i.e. via the above-mentioned water connection 101*a*, is fed via the nozzle 103*a* to a mixing chamber 106 formed by the pipe 104.

According to the so-called Venturi effect or the so-called Bernoulli's equation, due to the above-mentioned small diameter or cross-section $A_2$ of the nozzle 103*a*, i.e. due the narrowing formed by it, the flow velocity $v_2$ of the water is higher at that location than the flow velocity $v_1$ of the water in the pipe 103, and the pressure $p_2$ is lower at that location than the pressure $p_1$ in the pipe 103—at the location of the nozzle 103*a* (and, thus, also in the mixing chamber 106) a negative pressure $p_2$ is created.

By the negative pressure, a medium ("suction medium") provided by means of the above-mentioned capsule 7—here: the above-mentioned ingredient stored in the capsule 7—is sucked in via the suction line 105, said medium being supplied via the above-mentioned outlet, in particular the vacuum outlet 105*a* of the suction line 105, to the mixing chamber 106.

In the mixing chamber 106, between the water flowing in rapidly via the nozzle 103*a* and the surrounding medium supplied via the suction line 105 there are caused turbulences by friction; as a result thereof a mixing of the medium supplied via the suction line 105 and of the water flowing in via the nozzle 103*a* will take place. In this process, kinetic energy from the water jet will be transferred to the surrounding medium, whereby an effective conveying mechanism is provided. Furthermore, alternatively, in a corresponding manner as in conventional water jet pumps, a nebulizing process can be effected so that then a corresponding spray mist—containing water and the added medium—will exit at the water discharge 101*b* of the device 101 (for instance in case of a correspondingly different design of the water discharge 101*b*).

The device 101 shown in FIG. 6 can for instance be connected to the shower system 10 shown in FIG. 1 or to any other shower system in the manner as shown in FIG. 1 or in any other manner.

For instance, the above-mentioned tube 30*a* of the shower system 10 can be connected to the water discharge 101*b* of the device 101, and the water connection 101*a* of the device 101 can be connected to the mixer tap or mixing fitting 2 shown in FIG. 1 (which can supply to the device 101 corresponding amounts of water having the respectively selected temperature).

What is claimed is:

1. A device for use in personal hygiene when washing hands of a user of the device, which is designed and adapted such that an exchangeable capsule storing an ingredient can be inserted into the device, the device comprising a capsule wall opening appliance, and a piston pump adapted to deliver the ingredient stored in the capsule to a final outlet of the device provided in the piston pump without the addition of any further liquids and adapted to deliver the ingredient from the final outlet of the device provided in the piston pump directly to outside air surrounding the device, such that the ingredient stored in the capsule is configured to be applied to the hands of the user of the device without any added further liquids, wherein the capsule comprises several chambers, and wherein, depending on the position of the capsule in the device, a different chamber is in communication with the final outlet of the device.

2. The device according to claim 1, wherein the capsule wall opening appliance comprises means for damaging a capsule wall in order to open the capsule by exerting a pressure on the capsule wall.

3. The device according to claim 2, wherein the capsule wall opening appliance is adapted to push open or puncture the capsule wall to pierce a hole into the capsule wall.

4. The device according to claim 1, wherein the capsule is a disposable capsule or an expendable article.

5. The device according to claim 1, wherein the ingredient comprises one of a shampoo, shower gel, lotion and soap.

6. A capsule which i designed and adapted such that the capsule can be inserted into a device according to claim 1.

7. The capsule according to claim 6, which is designed and adapted such that the capsule comprises several chambers.

8. The capsule according to claim 6, wherein the ingredient comprises one of a shampoo, a shower gel, a lotion, and a soap.

9. A system comprising: a device according to claim 1, and the capsule configured to be inserted into the device.

10. The device according to claim 1, further comprising:
a means for pivoting the capsule.

11. A method for use in personal hygiene when washing hands of a user, which comprises the following steps:
inserting a capsule storing an ingredient into a device for use in personal hygiene;
opening a wall of the capsule; and delivering, by a piston pump, the ingredient stored in said capsule to a final outlet of the device provided in the piston pump without the addition of any further liquids and delivering the ingredient from the final outlet of the device provided in the piston pump directly to outside air surrounding the device, such that the ingredient stored in the capsule is applied to the hands of the user of the device without any added further liquids, wherein the capsule comprises several chambers, and wherein, depending on the position of the capsule in the device, a different chamber is in communication with the final outlet of the device.

12. The method according to claim 11, wherein the capsule is opened by damaging a capsule wall by exerting a pressure on the capsule wall.

13. The method according to claim 11, which further comprises the following step:

exchanging the capsule for a new capsule.

14. A device for use in personal hygiene when washing hands of a user of the device, which is designed and adapted such that an exchangeable capsule storing an ingredient can be inserted into the device, the device comprising a capsule wall opening appliance, and a piston pump adapted to deliver the ingredient stored in the capsule to a final outlet of the device without the addition of any further liquids, and adapted to deliver the ingredient from the final outlet of the device directly to outside air surrounding the device, such that the ingredient stored in the capsule is configured to be applied to the hands of the user of the device without any added further liquids, the device further comprising an appliance configured to pivot the capsule.

* * * * *